United States Patent [19]

Molz

[11] 4,240,369

[45] Dec. 23, 1980

[54] MAINSAIL AND/OR MIZZENSAIL FURLING DEVICE

[76] Inventor: Harold A. Molz, 17 Revell St., Annapolis, Md. 21401

[21] Appl. No.: 945,385

[22] Filed: Sep. 25, 1978

Related U.S. Application Data

[63] Continuation-in-part of Ser. No. 855,195, Nov. 28, 1977, Pat. No. 4,122,793.

[51] Int. Cl.[3] ..... B63H 9/04

[52] U.S. Cl. ..... 114/106; 114/94; 248/219.4

[58] Field of Search ..... 114/39, 94, 106, 107, 114/108, 113, 114, 95, 96, 93, 97–101; 248/219.1, 219.4

[56] References Cited

U.S. PATENT DOCUMENTS

| | | | |
|---|---|---|---|
| 40,273 | 10/1863 | McClain | 114/98 |
| 63,555 | 4/1867 | Pattison | 114/97 |
| 3,230,004 | 1/1966 | Lock | 294/82 R |
| 3,343,514 | 9/1967 | Brett | 114/108 |
| 3,602,180 | 8/1971 | Holmes | 114/107 |
| 3,749,042 | 7/1973 | Jackson | 114/106 |
| 3,964,419 | 6/1976 | Vecker | 114/106 |
| 4,122,793 | 10/1978 | Molz | 114/106 |

FOREIGN PATENT DOCUMENTS

| | | | |
|---|---|---|---|
| 29572 | 5/1884 | Fed. Rep. of Germany | 114/96 |

*Primary Examiner*—Trygve M. Blix
*Assistant Examiner*—D. W. Keen
*Attorney, Agent, or Firm*—Schwartz, Jeffery, Schwaab, Mack, Blumenthal & Koch

[57] ABSTRACT

The invention as disclosed provides an improved mainsail and/or mizzensail furling device for use on sailboats and includes a furling drum mounted on the gooseneck connecting the boom to the mast. An upper masthead holding device is movably mounted relative to the mast and includes a pair of pivoted mast engaging flanges. A first pair of substantially longitudinally extending arms are connected to the flanges and maintain a swivel a given distance from the mast. The halyard is connected to the swivel in a convenient fashion, and a second pair of arms are attached in such a way as to lead the halyard from the top of the swivel device at an angle of approximately 45° to the mast, to maintain the flanges substantially parallel to the mast to facilitate raising and lowering the device as well as a snug fit against the mast when the halyard is made taut. The flanges are pivoted to the first pair of arms so as to grip a variety of mast sizes and configurations.

10 Claims, 3 Drawing Figures

MAINSAIL AND/OR MIZZENSAIL FURLING DEVICE

CROSS-REFERENCE

This is a continuation-in-part of my previously filed application Ser. No 855,195, filed Nov. 28, 1977, now U.S. Pat. No. 4,122,793, issued Oct. 31, 1978, which is hereby incorporated by reference.

BACKGROUND OF THE INVENTION

The invention relates to an improved mainsail and/or mizzensail furling device and more particularly to improvements over my previously filed application Ser. No. 855,195, filed Nov. 28, 1977, now U.S. Pat. No. 4,122,793, *issued Oct.* 31, 1978, which disclosure is hereby incorporated by reference.

It has long been recognized that it is possible to furl the jib or other stay sails. This has been accomplished by roller-furling the jib or genoa. The larger mainsail has created other problems.

Mainsail roller-furling has been accomplished by either roller-furling the mainsail within the mast as illustrated in U.S. Pat. Nos. 3,835,804 and 4,030,439 or by permanently affixing the swivel device and/or drum to the mast such as in U.S. Pat. No. 3,749,042. In each of the prior art devices it has been necessary to either construct a mast which is specifically designed to contain the furled mainsail or to otherwise permanently alter the mast rigging. The prior art devices have either been extremely expensive or have rendered the mast unusable for "conventional" hauled sails.

My previous application included a pair of flanges rigidly connected to a pair of longitudinal arms. While my prior device works well, the flange would have to be welded or secured at a fixed or given angle, depending on the configuration of the mast to which it is to be used.

OBJECTS AND SUMMARY OF THE INVENTION

It is thus an object of the instant invention to provide an improved mainsail and/or mizzensail furling system which is relatively inexpensive and which neither requires a specifically designed mast nor a mast which requires permanent alteration thereof.

Another object is to provide means for furling and unfurling the mainsail and or mizzensail from the cockpit.

Still another object is to provide a mainsail and/or mizzensail furling device which will permit the use of either "conventional" or furled sails on the same mast with the minimum of alterations.

A further object is to provide a masthead holding device which is easily adaptable to a variety of mast sizes and configurations.

The invention provides an improved mainsail and/or mizzensail furling device for use on sailboats and includes a furling drum mounted on the gooseneck connecting the boom to the mast. An upper masthead holding means is movably mounted relative to the mast and includes a pair of mast pivoting engaging flanges. A first pair of substantially longitudinally extending arms are connected to the pivoting flanges and maintain a swivel a given distance from the mast. The halyard is connected to the swivel in a convenient fashion, and a second pair of arms are attached in such a way as to lead the halyard from the top of the swivel device at an angle of approximately 45° to the mast, to maintain the flanges substantially parallel to the mast to facilitate raising and lowering the device as well as a snug fit against the mast when the halyard is made taut. The flanges are pivoted to the first pair of arms so as to grip a variety of mast sizes and configurations.

BRIEF DESCRIPTION OF THE DRAWINGS

The above and other objects, features and advantages of the invention will become readily apparent from the following description of a preferred embodiment of the invention taken with the accompanying drawings wherein.

DETAILED DESCRIPTION OF THE INVENTION

Figure 1:
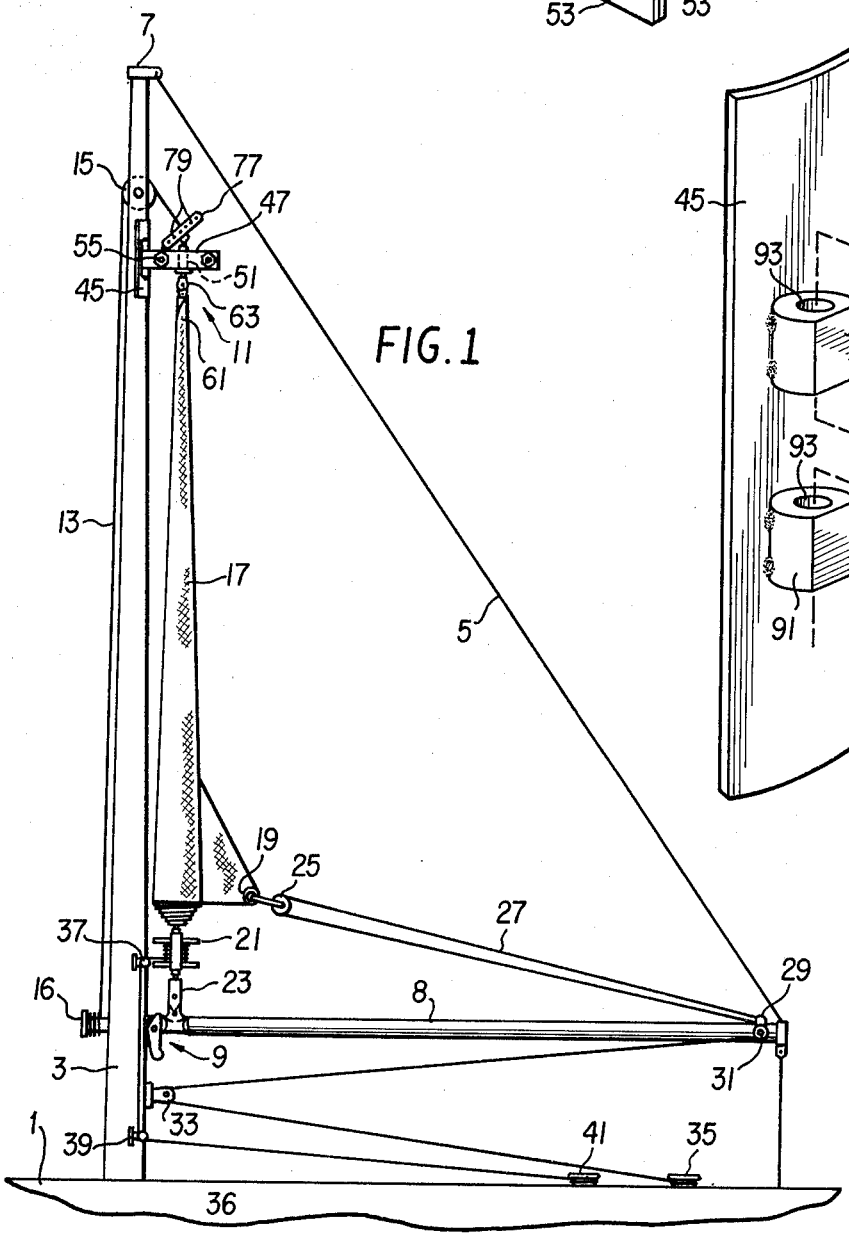
FIG. 1 is a side elevational view of the device of the present invention mounted on the mast of a sailboat.

Referring now to FIG. 1 a deck 1 has a conventional mast 3 extending upward therefrom. A conventional topping lift 5 extends from the masthead 7 to the outer end of a boom 8 which is in turn attached to the mast 3 by means of a conventional gooseneck 9.

A masthead holding device 11 to be discussed in greater detail below has a halyard 13 connected thereto and passing over a conventional block 15 at the masthead and attached to a cleat or winch 16 adjacent the gooseneck 9. A sail 17 is seen in a generally furled position in FIG. 1. A clew 19 of the sail is positioned above a conventional furling drum 21 of the type used in jib furling mechanisms. The drum is connected to the boom gooseneck 9 by a connector 23. Also attached to the clew 19 is a block 25 to which an outhaul 27 is attached. The rolling of the mainsail and the use of the outhaul 27 will be discussed below. However, it will be seen that the outhaul has an end attached to a standing part 29 and passes over the block 25 at the clew to a second block 31 adjacent the bitter end of the outhaul at 29, to a third block 33 attached to the mast and terminating at a cleat 35.

The drum 21 has a drum line 36 seen in the wound position. The drum line passes over a block 37 secured to the mast adjacent the drum, extends downwardly and over another block 39 secured near the base of the mast and to a cleat 41 on the deck adjacent cleat 35 in the area of the cockpit.

The mast 3 includes a conventional track for raising and lowering a conventional mainsail. Alternatively, the mast could be slotted to receive what is called a rope luff instead of the externally mounted slide. Since neither the slide nor the slot are affected by the instant invention, it will be appreciated that they do not form a part of the invention; however, as will be better appreciated from the discussion below, the device 11 can be removed, and the "conventional" mainsail can be hauled up the mast.

Figure 2:
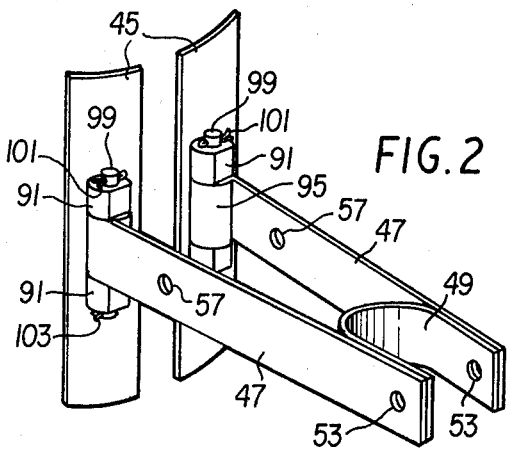
FIG. 2 is a perspective view of the invention.
Figure 3:
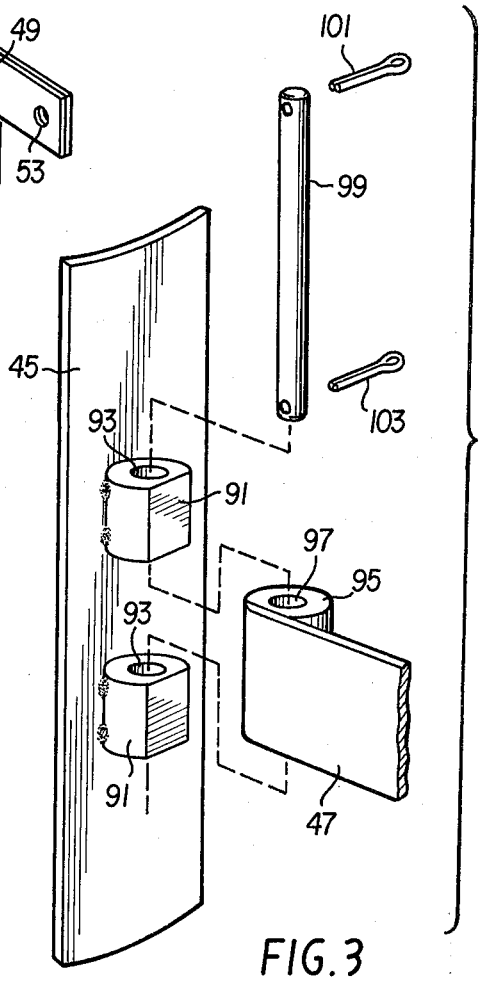
FIG. 3 is an enlarged, fragmentary, exploded, perspective view of the device illustrated in FIG. 2.

Referring to FIGS. 2 and 3, a pair of flanges 45 conform to the shape of the mast 3 and are attached by pivoting (to be discussed below) to a pair of longitudinal arms 47. The arms extend rearwardly in the direction of the stern and receive a U-shaped element 49 which retains a conventional upper swivel mechanism 51. The mechanism 51 is retained in the U-shaped element 49 and arms 47 as illustrated in my prior application by a bolt through openings 53 and a nut or pair of nuts. Approximately midway along the length of the arms 47 is a second bolt 55 inserted in opening 57 thereon with a nut or nuts for adjusting the flanges 45 to the approximate contour of the mast 3 for optimum fit.

A swivel element of a conventional nature forming a part of the overall swivel mechanism 51 is held within the U-shaped swivel retainer 49. The head of the sail seen generally at 61 is connected to a conventional sail retainer 63 and is designed to rotate with a swivel element in swivel device 51. The halyard 13 is connected to a fixed element of the conventional upper swivel mechanism 51, which in turn connects to the swivel element per se. Thus, the sail is able to be furled and unfurled around a wire or rod connected between retainer 63 and drum 21. The halyard 13 is connected to the upper swivel mechanism 51 by a loop, shackle or other device affixed to the fixed element.

Positioned on the bolt 56 as best seen in my prior application is a U-shaped bracket secured to the bolt extending through opening 57 by means of a nut and bolt arrangement. A narrow portion on the U-shaped bracket has a bore therethrough to receive a nut and bolt positioned at the outer end thereof. Connected to the narrow portion by means of a nut and bolt is a halyard maintaining means in the form of a pair of arms 77 (FIG. 1) which are located at approximately a 45° angle relative to the longitudinal arms 47. A plurality of holes 79 are located in the arms 77. The loop on halyard 13 abuts against another bolt in one of openings 79 to achieve an approximate 45° angle. The purpose of the arms 79 and bolt is to maintain the halyard at an approximate 45° angle, thus providing the proper force on arms 47 so that the flanges 45 are parallel to the mast at all times, including when the device is being hauled up the mast. This facilitates the seating at the top of the mast so that the unit will not become hung up and/or pivot. It will be appreciated that it is necessary to hold the swivel off of the mast approximately the same distance as the center of the drum is offset from the foot. Further, it is necessary to provide means for holding the casing of the swivel immovable so that the swivel element only will rotate with the sail. Otherwise the entire swivel mechanism will rotate and unlay the halyard wire.

The pivoting flange seen in FIGS. 2 and 3 includes a pair of brackets 91 which are, for example, welded to the flange 45. Each bracket 91 includes an opening 93 therethrough. Welded or otherwise secured to arms 47 are a pair of brackets 95 having an opening 97 therein. As seen in the exploded view of FIG. 3, the brackets 95 lift between brackets 93 and wherein holes or openings 93 and 97 are aligned. A pin 99 is then inserted into openings 93 and 97. Finally, an upper cotter pin 101 and a lower cotter pin 103 are inserted to hold the pins in place.

OPERATION

In order to install the mainsail and/or mizzensail furling device, it is first necessary to attach the conventional drum to the gooseneck of the boom in a conventional manner by means of a fixed element 23. The upper swivel device must be hauled up the mast by attaching halyard 13 to the fixed element underneath or below the bolt in opening 79 in arms 77. The unit is positioned against the mast by placing the pivoting flanges 45 joined together as discussed above thereagainst and tightening the nut and bolt arrangement in openings 57 so that there is sufficient grasping pressure, yet freedom to slide. The halyard 13 is then pulled downwardly by means of a winch at 16 (or attaching the end to a cleat at 16) unit the unit 11 has reached its uppermost position adjacent block 15.

The sail is then furled onto the device as seen in FIG. 1. To unfurl the mainsail the outhaul 27 is removed from cleat 35, and the drum line 36 is removed from cleat 41. A force is then exerted by the helmsman on outhaul 27. This will shorten outhaul 27 as it moves over blocks 33, 31 and 25, pulling the clew 19 toward the standing part 29. When the sail clew has reached part 29 it will be in the completely "raised" position. The lines 27 and 36 are then secured to their respective cleats.

When it is desired to furl the sail, the outhaul is again released from cleat 35, and the drum line 36 released from cleat 41. The drum line is then pulled which in turn rotates the drum in a conventional manner to furl the sail and the lines are ultimately returned to the position shown in FIG. 1.

While the invention has been described, it will be understood that it is capable of further modifications, and this application is intended to cover any modifications, uses, or adaptions of the invention and including such departures from the present disclosure as come within known or customary practice in the art to which the invention pertains, and as may be applied to the essential features here and before set forth and as fall within the scope of the invention or limit of the appended claims.

What is claimed is:

1. A mainsail furling device for use on a sailboat having a mast, a halyard extending up the mast toward a masthead and then extending downwardly therefrom, the mast having a boom connected thereto and being mounted on the device of the sailboat, and the sailboat having a bow and a stern, the device comprising:

(a) a lower swivel means mounted on the sailboat adjacent the base of the mast;

(b) an upper masthead holding means movably mounted on the mast adjacent the masthead, said upper masthead holding means including:

(1) flange means for engaging the mast having a first pair of arms pivotally connected thereto, (2) a swivel retained in said arms, (3) means including said arms for maintaining said swivel a distance in the direction of the stern from the mast and substantially parallel to the mast, (4) means for connecting said holding means to the halyard, (5) means for connecting said swivel to the mainsail.

2. A furling device as defined in claim 1 wherein said lower swivel means is mounted on the boom.

3. A furling device as defined in claim 2 including a gooseneck connecting the boom to the mast, said lower swivel means including a furling drum mounted on the gooseneck, and means connecting said furling drum to the sail.

4. A furling device as defined in claim 1 wherein said holding means further includes means for maintaining the downwardly extending portion of the halyard at approximately 45° to the mast when the holding means is adjacent the masthead.

5. A furling device as defined in claim 1 including a second arm means connected approximately at a 45° angle to said first pair of arms, said second arm means including means for maintaining the halyard at an angle of approximately 45° to the mast and said first pair of arms.

6. A furling device as defined in claim 1 wherein said pivotal connecting means includes bracket means on said flange means and bracket means on said first pair of arms, and a pin joining said bracket means.

7. A masthead holding device for a mainsail and/or mizzensail furling system comprising:

(a) means for non-permanently engaging a mast including a pair of mast engaging flanges, (b) a pair of substantially longitudinally extending arms, said flanges each being pivotally connected about a vertical axis to said arms, (c) a swivel maintained a distance from the mast by said arms, (d) means for connecting a halyard to said swivel, (e) means connected to said arms for maintaining said swivel substantially parallel to the mast and not rotatable relative thereto.

8. A device as defined in claim 7 including means on said means connected to said arms for receiving the halyard therethrough.

9. A device as defined in claim 7 including means for maintaining the halyard at an angle of approximately 45° to the mast and said pair of arms.

10. A device as defined in claim 7 wherein said flanges are pivotally connected to said arms by a pair of bracket means, one bracket means being positioned on said flanges and the other bracket means being positioned on said arms, and means for pivotally joining said brackets together.

* * * * *